United States Patent [19]

Christiansen

[11] Patent Number: 4,530,345

[45] Date of Patent: Jul. 23, 1985

[54] STOVE FOR ROUND BOTTOM VESSELS

[76] Inventor: Jens H. Christiansen, 1825 State St., Santa Barbara, Calif. 93101

[21] Appl. No.: 125,338

[22] Filed: Feb. 28, 1980

[51] Int. Cl.[3] ..... F24C 3/08

[52] U.S. Cl. ..... 126/40; 126/39 E; 126/260

[58] Field of Search ..... 126/260, 248, 249, 252, 126/256, 39 B, 40, 50; 211/41, 69.9, 71, 133

[56] References Cited

U.S. PATENT DOCUMENTS

| | | | |
|---|---|---|---|
| 129,555 | 7/1872 | Hauck | 126/260 |
| 936,815 | 10/1909 | Schemnitz | 126/40 |
| 2,011,125 | 8/1935 | Small | 126/40 |
| 4,313,416 | 2/1982 | Lau | 126/39 E |

FOREIGN PATENT DOCUMENTS

| | | | |
|---|---|---|---|
| 68903 | 3/1949 | Denmark | 126/40 |
| 999427 | 1/1952 | France | 126/40 |
| 1238313 | 7/1960 | France | 126/40 |
| 3203 | of 1880 | United Kingdom | 126/40 |
| 3405 | of 1901 | United Kingdom | 126/252 |
| 24359 | of 1907 | United Kingdom | 126/256 |

*Primary Examiner*—Randall L. Green

*Attorney, Agent, or Firm*—Harry W. Brelsford

[57] ABSTRACT

A stove for supporting cooking pans and vessels that have rounded or spherical bottoms has three spaced uprights having their upper ends inclined inwardly toward each other. The three uprights are preferably spaced about a heat source and preferably have their upper ends terminate in a single horizontal plane.

2 Claims, 3 Drawing Figures

STOVE FOR ROUND BOTTOM VESSELS

My invention relates to a stove for Chinese woks and has particular reference to a stove giving three point support to Chinese woks and other cooking vessels having generally spherical or rounded bottoms.

Ordinary stoves are unsatisfactory for supporting Chinese woks. These cooking vessels have generally spherical bottoms and most stoves are designed for flat bottom cooking vessels and pans. Round bottom or spherical bottom pans and vessels do not get adequate support from the standard stoves and tend to roll around on the stove top. Special structures are required to not only stabilize them but to hold them securely during vigorous stirring of the contents.

Various stove structures have been devised to hold round bottom vessels but few have been satisfactory. Round openings in flat topped stoves have been tried but unless they are very large, only a portion of the pan is heated. Round rings on a stand are also available, but if used for woks these would be subject to the same drawbacks as round holes in flat stove tops. Crossed tripod rods are also available but leave little room for a heat source.

BRIEF SUMMARY OF THE INVENTION

I have devised a three point support for woks that does not interfere with the heating of the entire bottom of the wok. I provide three spaced upright supports that have upper ends that curve toward each other, but are spaced from each other and terminate generally in a horizontal plane. The inwardly curving uprights not only provide space under the wok for a heat source of any kind (including a charcoal brazier) but also give great mechanical rigidity. The wok is securely supported and even the most vigorous stirring does not dislodge it or cause it to tilt.

DETAILED DESCRIPTION

Various objects, advantages and features of the invention will be apparent in the following description and claims considered together with the drawings forming an integral part of this specification and in which:

Figure 1:
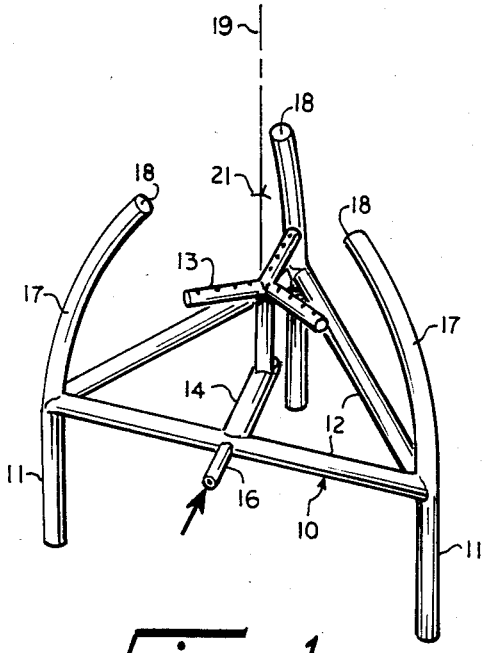
FIG. 1 is a three dimensional view of a triangular frame supporting three uprights incorporating my invention.
Figure 2:
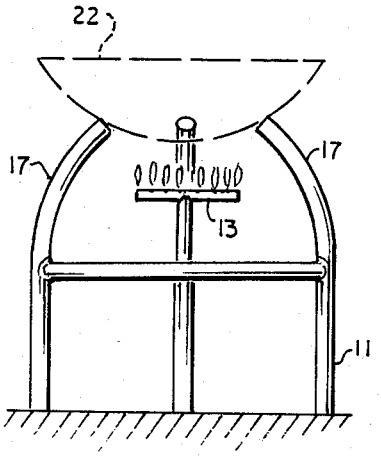
FIG. 2 is the elevation view of the triangular frame of FIG. 1 and shown in broken outline is a Chinese wok cooking vessel supported by the uprights.

Referring to FIGS. 1 and 2 there is illustrated a frame 10 having three supporting legs 11 for a triangular frame consisting of horizontal members 12. Disposed centrally in the frame 10 is a burner or other source of heat 13 mechanically supported by a tube 14 secured to one of the horizontal triangular members 12. A fuel pipe 16 passes through the mechanical support 14 to supply fuel to the burner 13. Provided particularly in accordance with the invention are three uprights 17 having their upper ends inclined toward each other and each terminating at an upper tip 18 wherein all three of the upper tips 18 are disposed generally in a horizontal plane. Projecting from the center of the burner 13 is a generally vertical axis 19 and where the imaginary horizontal plane intersects this axis at 21 the tips 18 are preferably approximately an equal distance from this axis 19.

Referring to FIG. 2 there is illustrated the stove of FIG. 1 wherein a Chinese wok 22 is shown in broken outline resting on the uprights 17. This support of the wok 22 is especially rigid in that the upper ends of the uprights 17 meet the wok 22 at approximately right angles giving great resistance to bending and other forces generated by vigorous stirring of the contents in the wok 22. Inasmuch as the lower ends of the uprights 17 are spaced a great distance away from the central burner 13 there is a great amount of room for using a heat source of any type; for example, a charcoal brazier could be inserted between the uprights 17 and underneath the wok 22. Any other suitable heat source could, of course, be used and the heat source 13 is merely illustrative. It will be noted further with respect to FIG. 2 that the heat from the burner 13 can travel upwardly along the entire surface of the wok and is not confined to a particular area as is the case when woks are supported by a ring or a hole in a flat stove surface.

Figure 3:
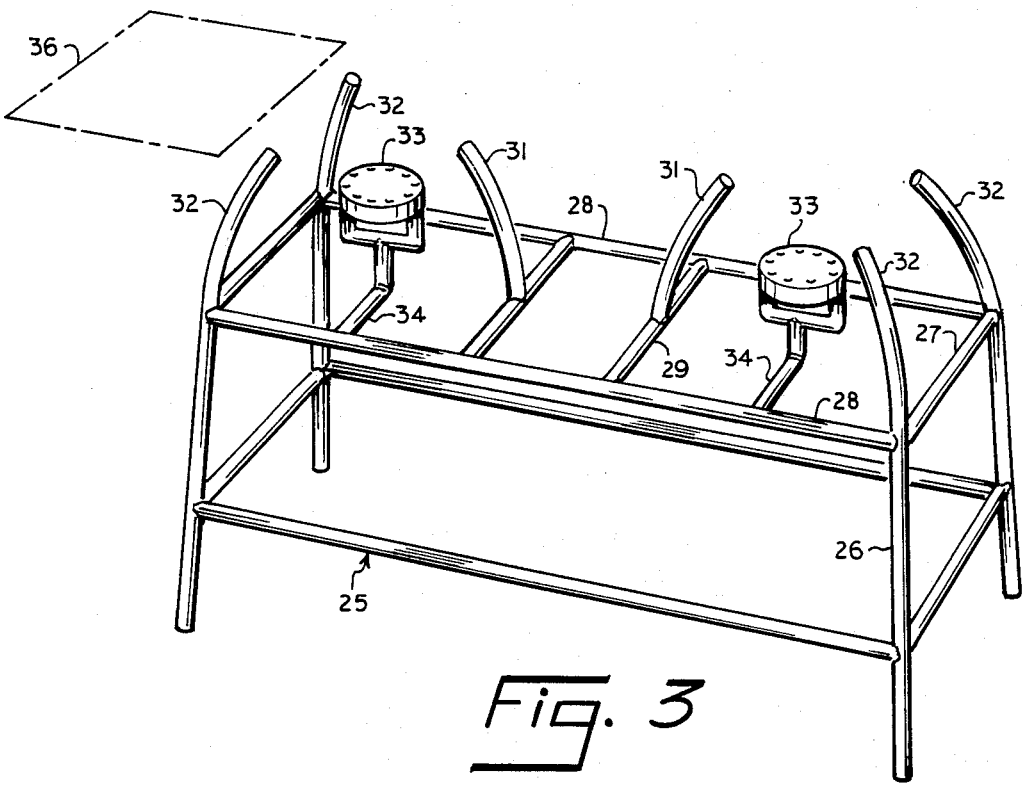
FIG. 3 is a three dimensional view of a double burner stove employing two sets of uprights in accordance with the invention and showing at the left hand side a horizontal plane at which the uprights generally terminate.

Referring to FIG. 3 there is illustrated a two-burner stove on a single frame. A frame 25 may have four supporting posts 26 terminating in an upper horizontal frame composed of end of members 27 and longitudinal members 28. A pair of cross bars 29 secured to the longitudinal members 28 each carry an upright wok support 31. At each corner of the frame 25 are additional wok supports 32 and these have their upper ends inclined inwardly toward a pair of central burners 33; the burners 33 in turn are mechanically supported by a right angled pipe 34 secured to one or both of the longitudinal frame members 28. The burners are supplied with fuel from any suitable source (not shown).

Referring still to FIG. 3 the tops of the uprights 31 and 32 preferably terminate in a horizontal plane and this is indicated diagramatically by the broken outline 36. The two burner stove of FIG. 3 can be designed for woks of different sizes and, accordingly, the uprights 31 and 32 may be of greater or shorter length at each end and more or less inclination toward the burner to support bigger or smaller woks and each burner under these conditions would have a different horizontal plane 36 disposed in a different elevation. Similarly to FIG. 1 the uprights of FIG. 3 may be spaced approximately the same distance from a vertical axis through the burners measured in the plane for the tips of the uprights at each end of the stove 25.

It will be recognized as a matter of geometry that it is not necessary for the three uprights to terminate in the same horizontal plane. One can be shorter than the other or all three different heights and still give good support because of the tripod nature of the support for a spherical surface. The greatest stability, however, occurs when the uprights terminate in the same horizontal plane and when there is approximately equal distance from an axis to the burner. Also, as a matter of geometry it will be appreciated that the upper ends of the upright do not have to be equal distance from an axis through the burner as various basings will similiarly support a spherical surface. For example, if the tips of all three supports were in a line they could not support a spherical surface, but if they are out of alignment they can support, with greater or lesser amounts of stability, any spherical surface.

Any suitable structural material may be used, and I presently prefer lightweight tubing for outdoor stoves of the type illustrated; for example, electrical conduit may be used. It is not necessary that the uprights be curved to dispose their inner ends toward each other; they could have angular bends in them and still function effectively. The greatest structural strength, however, is generally achieved with a curve as shown. Also as a matter of geometry it is apparent that any number of upright supports over three may be used. The size of the wok with respect to the spacing of the support tips is a matter of personal choice but the most secure support occurs when the supports are not too close to the outer perimeter of the wok. The uprights are most useful when inclined inwardly, as straight vertical supports are more subject to bending as the wok or other vessel tends to wedge them apart.

I have described my invention with respect to the presently preferred embodiments thereof as required by the statutes. These are illustrative, however, and are not limiting and there is encompassed within the scope of the following claims all modifications and variations that fall within the true spirit and scope of the invention.

I claim:

1. A stove for chinese wok cooking vessels comprising (a) a source of heat having a vertical axis; and (b) at least three upright supports each having an upper end face, said supports being spaced about the heat source and having curvilinear upper end sections inclined towards each other, said supports terminating at said end faces whose upper peripheral edge regions are in a generally horizontal plane, said end faces being generally equidistant from the vertical axis through the center of said heat source, said curvilinear upper end sections of the supports being at an angle approximately midway between the vertical axis of said heat source and said horizontal plane;

whereby a round bottom cooking vessel has at least three support contacts when placed over the heat source and upon said upper end faces.

2. In combination with a round bottom cooking vessel a stove for the vessel comprising (a) a source of heat having a vertical axis; and (b) at least three upright supports each having an upper end face, said supports being spaced about the heat source and having curvilinear upper end sections inclined towards each other, said supports terminating at said end faces whose upper peripheral edge regions are in a generally horizontal plane, said end faces being generally equidistant from the vertical axis through the center of said heat source, said curvilinear upper end sections of the supports being an angle approximately midway between the vertical axis of said heat source and said horizontal plane;

whereby a round bottom cooking vessel has at least three support contacts when placed over the heat source and said upper end faces.

* * * * *